US007885586B2

(12) United States Patent
Yamamoto

(10) Patent No.: US 7,885,586 B2
(45) Date of Patent: Feb. 8, 2011

(54) IMAGE FORMING APPARATUS

(75) Inventor: Satoru Yamamoto, Abiko (JP)

(73) Assignee: Canon Kabushiki Kaisha (JP)

( * ) Notice: Subject to any disclaimer, the term of this patent is extended or adjusted under 35 U.S.C. 154(b) by 565 days.

(21) Appl. No.: 11/949,762

(22) Filed: Dec. 3, 2007

(65) Prior Publication Data

US 2008/0129812 A1 Jun. 5, 2008

(30) Foreign Application Priority Data

Dec. 4, 2006 (JP) ..... 2006-327114

(51) Int. Cl.
*G03G 15/01* (2006.01)

(52) U.S. Cl. ..... 399/301; 399/49; 399/394; 399/396

(58) Field of Classification Search ..... 399/49, 399/301, 394, 396
See application file for complete search history.

(56) References Cited

U.S. PATENT DOCUMENTS 6,014,542 A * 1/2000 Hozumi et al. ..... 399/396
2008/0038004 A1* 2/2008 Inoue ..... 399/301

FOREIGN PATENT DOCUMENTS

| | | | |
|---|---|---|---|
| JP | 06-093145 | A | 4/1994 |
| JP | 11-194561 | A | 7/1999 |
| JP | 2000-199988 | A | 7/2000 |
| JP | 2001-215857 | A | 8/2001 |

* cited by examiner

*Primary Examiner*—Ryan D Walsh
(74) *Attorney, Agent, or Firm*—Rossi, Kimms & McDowell LLP

(57) ABSTRACT

An image forming apparatus capable of always performing image registration adjustment with a high accuracy and realizing a higher image quality without lowering the productivity and deteriorating a cleaning member. A first conveying speed of a sheet being conveyed on a conveying path is changed to a second conveying speed at a predetermined position to thereby perform registration of an image on an image bearing member with the sheet, at a position of the image being transferred to the sheet. Detecting an registration-use image on the image bearing member causes a first reference signal to be generated, and detecting a top end of the sheet conveyed on the conveying path causes a second reference signal to be generated. The predetermined position is determined on the basis of the first reference signal when the registration-use image sensor has successfully generated the first reference signal, and the predetermined position is determined on the basis of the second reference signal when the registration-use image sensor does not successfully generate the first reference signal.

5 Claims, 16 Drawing Sheets

IMAGE FORMING APPARATUS

BACKGROUND OF THE INVENTION

1. Field of the Invention

The present invention relates to an image forming apparatus such as a copying machine and a printer, and more particularly, to an image forming apparatus characterized by a technique of performing registration of an image to be formed, with a sheet being conveyed.

2. Description of the Related Art

There has been proposed a technique for an image forming apparatus in which, prior to an image being transferred to a sheet, a registration patch is formed on a photosensitive member, between sheets, and performing registration of the image with the sheet at a timing of detecting the registration patch as a reference (for example, see Japanese Laid-Open Patent Publication (Kokai) No. 11-194561).

There has also been proposed a technique of correcting the timing of registration by a patch in order to follow change in the perimeter of an intermediate transfer member and the like (for example, see Japanese Laid-Open Patent Publication (Kokai) No. 2001-215857).

There has also been proposed a technique of, in a case where there is a scratch or the like on the photosensitive member or the intermediate transfer member at a position of the registration patch being formed, invalidating the image or moving the image position.

As described above, in a conventional image forming apparatus, if an image is invalidated in a case where there is a scratch or the like on a photosensitive member or an intermediate transfer member at a position of a registration patch being formed, the used developing solution is wasted, and furthermore, a cleaning member is deteriorated and the productivity is lowered. In the case of moving the image position also, the lowering of the productivity cannot be avoided.

SUMMARY OF THE INVENTION

The present invention provides an image forming apparatus capable of always performing image registration adjustment with a high accuracy and realizing a higher image quality without lowering the productivity and deteriorating a cleaning member.

In an aspect of the present invention, there is provided an image forming apparatus comprising a registration device adapted to change a first conveying speed of a sheet being conveyed on a conveying path to a second conveying speed at a predetermined position to thereby perform registration of an image on an image bearing member with the sheets at a position of the image being transferred to the sheet, the image forming apparatus further comprising: a forming device adapted to form a registration-use image on the image bearing member; a registration-use image sensor adapted to detect the registration-use image on the image bearing member to thereby generate a first reference signal; and a sheet detection sensor adapted to detect a top end of the sheet conveyed on the conveying path to thereby generate a second reference signal, wherein the registration device is adapted to determine the predetermined position on the basis of the first reference signal when the registration-use image sensor has successfully generated the first reference signal, and to determine the predetermined position on the basis of the second reference signal when the registration-use image sensor does not successfully generate the first reference signal.

The second conveying speed can be less than the first conveying speed.

The second carrying speed can be an image forming process speed.

The second reference signal can comprise a learned value of the detected data of the registration-use image on the image bearing member.

The learned value can include an average value of plural pieces of data obtained.

According to the present invention, a first conveying speed of a sheet being conveyed on a conveying path is changed to a second conveying speed at a predetermined position to thereby perform registration of an image on an image bearing member with the sheet, at a position of the image being transferred to the sheet. Furthermore, detecting the registration-use image on the image bearing member causes a first reference signal to be generated, and detecting a top end of the sheet conveyed on the conveying path causes a second reference signal to be generated.

According to the present invention, the predetermined position is determined on the basis of the first reference signal when the registration-use image sensor has successfully generated the first reference signal, and the predetermined position is determined on the basis of the second reference signal when the registration-use image sensor does not successfully generate the first reference signal. Thus, it is possible to always perform registration adjustment with a high accuracy and realize a higher image quality without lowering the productivity and deteriorating a cleaning member.

The above and other objects, features, and advantages of the invention will become more apparent from the following detailed description taken in conjunction with the accompanying drawings.

DETAILED DESCRIPTION OF THE PREFERRED EMBODIMENTS

The present invention will now be described in detail with reference to the drawings showing preferred embodiments thereof.

Figure 1:
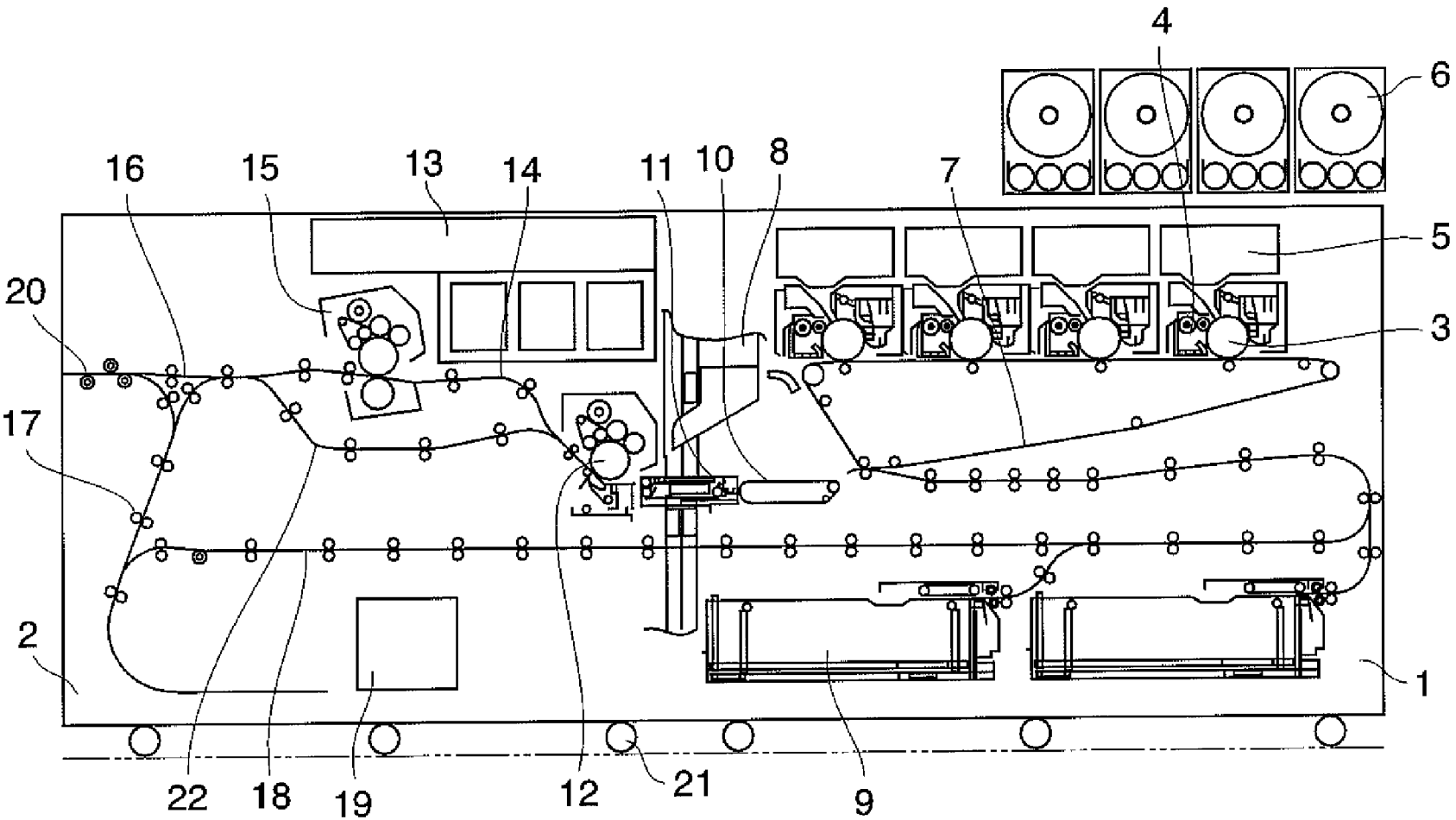
FIG. 1 is a view schematically showing the entire configuration of an image forming apparatus according to an embodiment of the present invention.

FIG. 1 is a view schematically showing the configuration of an image forming apparatus according to an embodiment of the present invention.

In FIG. 1, the image forming apparatus according to the embodiment of the present invention has an apparatus main body configured mainly by a first chassis unit 1 and a second chassis unit 2.

This image forming apparatus is provided with photosensitive drums 3, exposure sections 5 which expose image information to the photosensitive drums 3 to form latent images, development devices 4 which attach toner on the latent images formed on the photosensitive drums 3 to develop the images. There are arranged four image forming sections for yellow, magenta, cyan and black.

This image forming apparatus is configured by hopper sections 6 which supply toner to the development devices 4, an intermediate transfer member 7 which sequentially transfers the toner images developed on the photosensitive drums 3 and collectively transfers the toner images to a sheet, and a fan (not shown), and provided with an exhaust device 8 which discharge air inside the apparatus main body.

Furthermore, this image forming apparatus is provided with a sheet feeding section 9 which feeds a sheet and a first belt conveying device 10 which conveys the sheet for which transfer has been performed, to the second chassis unit 2. Furthermore, this image forming apparatus is provided with a second belt conveying device 11 which conveys the sheet on which the not-yet-fixed toner images which have been transferred at the first chassis unit 1 are placed, to the second chassis unit 2.

Furthermore, the above image forming apparatus is provided with a first fixing unit 12 which fixes the not-yet-fixed toner images transferred within the first chassis unit 1, on the sheet, a second fixing unit 15 which is connected with the first fixing unit 12 via a conveying path 14 and which is for achieving a high image quality by gloss control, an exhaust duct 13 which discharges mainly the heat of the first fixing unit 12 and the second fixing unit 15 in the second chassis unit 2, and a re-fed paper conveying path 16 which guides the sheet to be re-fed in the case of double-sided recording.

The above image forming apparatus is further provided with an inversion path 17 for inversing the sheet to be re-fed, a double-side path 18 for conveying the reversed paper to the intermediate transfer member 7, a waste toner bottle 19, a paper discharge path 20 for discharging the sheet on which an image has been formed, and casters 21.

Furthermore, the image forming apparatus is provided with a bypass conveying path 22 for conveying the sheet which has passed through the first fixing unit 12 directly to the re-fed paper conveying path 16 or the sheet discharge path 20.

Figure 2:
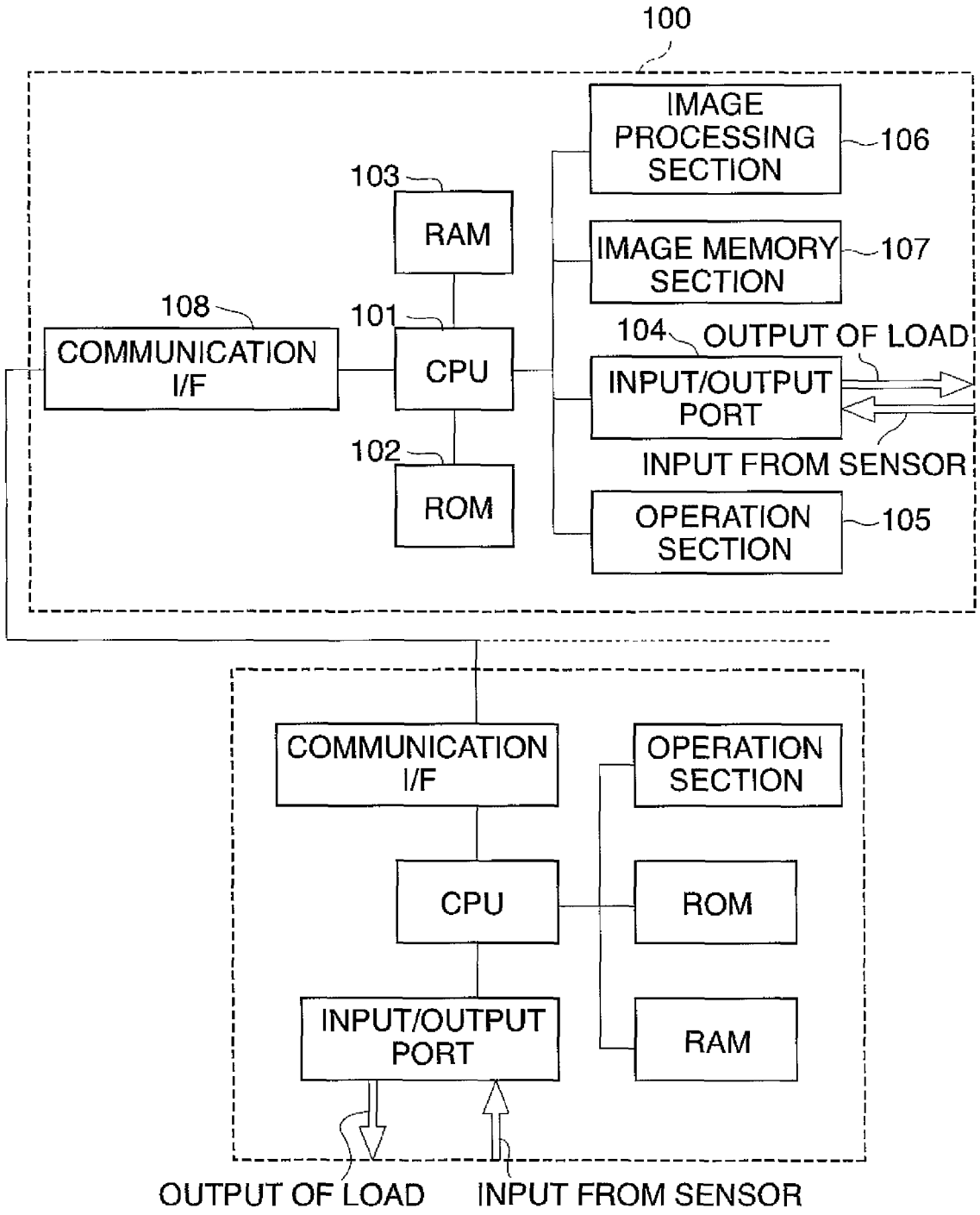
FIG. 2 is a block diagram schematically showing the configuration of a control section provided for the image forming apparatus in FIG. 1.

FIG. 2 is a block diagram schematically showing the configuration of a control section provided for the image forming apparatus in FIG. 1.

In FIG. 2, a control section 100 is provided with a CPU 101 which performs basic control of the image forming apparatus. To the CPU 101, a ROM 102 in which a control program is written, a work RAM 103 for performing processing and an input/output port 104 are connected via an address bus and a data bus.

The work RAM 103 has a partial area for a backup RAM where data is not erased even when the power is turned off. To the input/output port 104, there are connected various load devices such as a motor and a clutch controlled by the image forming apparatus, and input devices for input to the image forming apparatus such as a sensor for detecting the position of the sheet.

The CPU 101 sequentially controls input and output via the input/output port 104, in accordance with the contents of the control program in the ROM 102 and implements image forming processing. Furthermore, an operation section 105 is connected to the CPU 101, and the CPU 101 controls a display section and a key input section of the operation section 105.

A user instructs switching of image forming operation modes or displaying modes to the CPU 101 via the key input section, and the CPU 101 displays the operation state of the image forming apparatus or the operation mode set by a key input, on the display section of the operation section 105 (the details will be described later with reference to FIG. 4).

Furthermore, an image processing section 106 which processes an image signal and an image memory section 107 in which the processed images are accumulated are connected to the CPU 101 (the details will be described later with reference to FIG. 4). The control section 100 is connected to an external control section shown by a broken line in the figure, via a communication interface 108.

Figure 3:
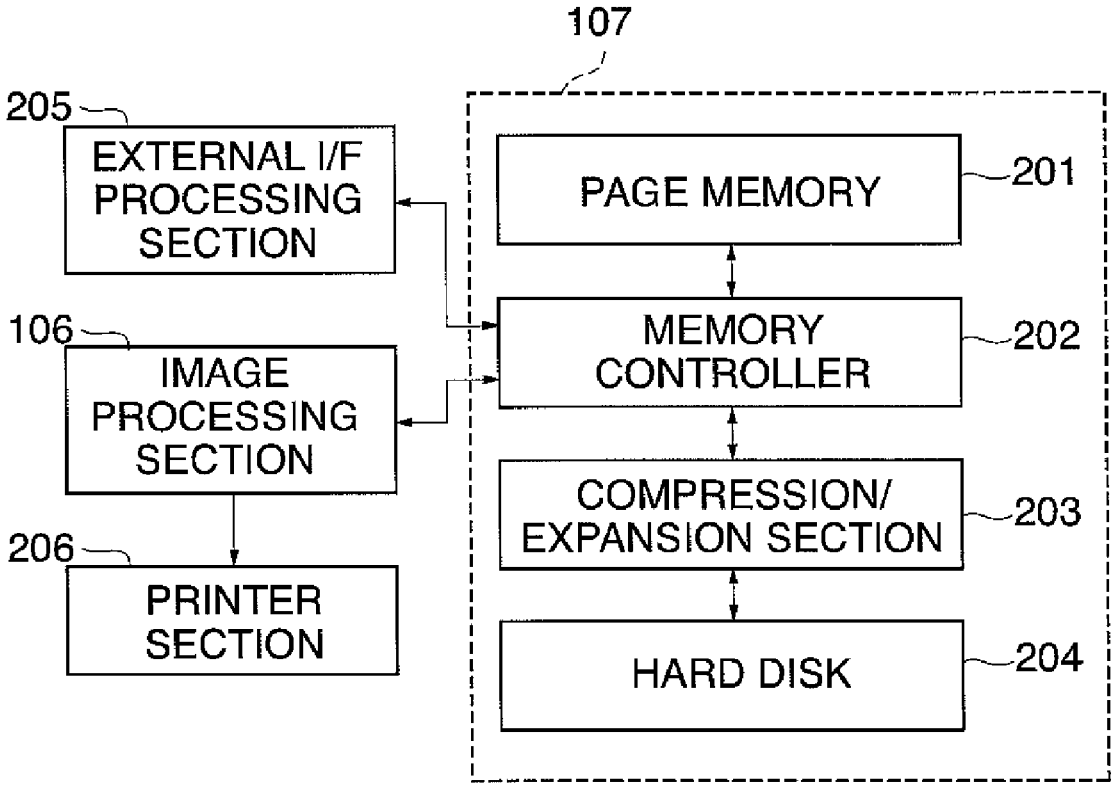
FIG. 3 is a block diagram schematically showing the block configuration of an image memory section in FIG. 2 and peripheral devices around the image memory section.

FIG. 3 is a block diagram schematically showing the configuration of the image memory section 107 in FIG. 2 and the peripheral devices around the image memory section.

In FIG. 3, the image memory section 107 is configured by a page memory 201, a memory controller 202, a compression/expansion section 203 and a hard disk 204.

Image data sent to the image memory section 107 from an external interface processing section 205 and the image processing section 106 is written in the page memory 201 by the memory controller 202, and then, the image data is sent to a printer section 206 via the image processing section 106 or accumulated in the hard disk 204.

When the image data is accumulated in the hard disk 204, the image data is compressed by the compression/expansion section 203 and written in the hard disk 204 as compressed data. The memory controller 202 also performs reading of the image data stored in the hard disk 204 to the page memory 201.

In this case, the compressed data read from the hard disk 204 is expanded via the compression/expansion section 203, and the restored image data is written in the page memory 201. Furthermore, the memory controller 202 generates a DRAM refresh signal to be sent to the page memory 201.

The memory controller 202 also coordinates accesses to the page memory 201 from the external interface processing section 205, the image processing section 106 and the hard disk 204. Furthermore, the memory controller 202 determines an address for writing to the page memory 201, an address for reading from the page memory 201, the direction of reading and the like.

After arranging multiple original images on the page memory 201 and performing layout, the CPU 101 can control a function of performing output to the printer section 206 via the image processing section 106, a function of cutting a part of an image and outputting it, and a function of rotating an image.

Figure 4:
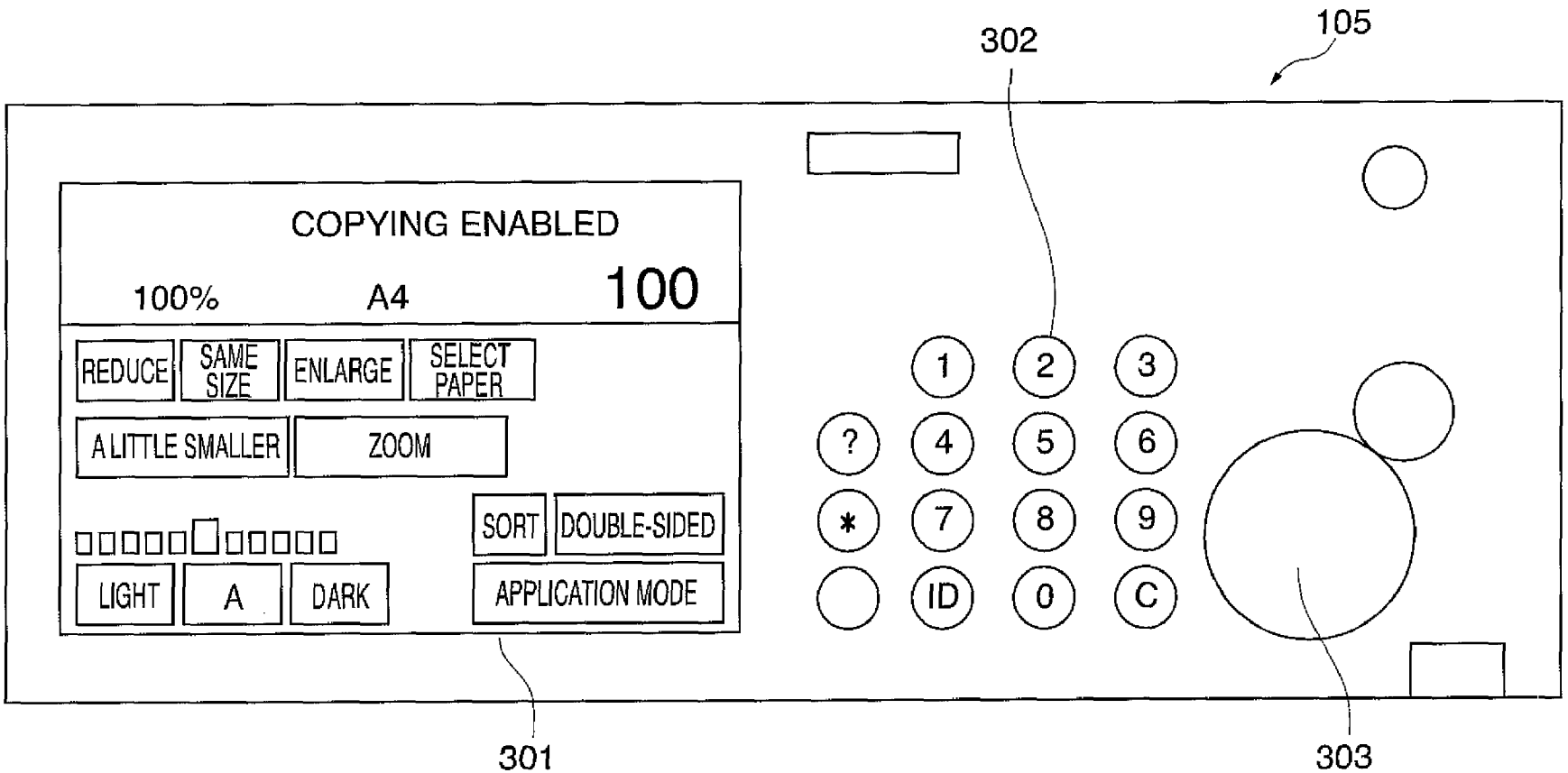
FIG. 4 is a view schematically showing the configuration of an operation section in FIG. 2.

FIG. 4 is a view schematically showing the configuration of the operation section 105 in FIG. 2.

In the operation section 105 shown in FIG. 4, a display section 301 displays various messages such as a message showing the operation state of the apparatus and a work instruction to a user, work procedures and the like are displayed. The surface of the display section 301 is configured by a touch panel, and the display section 301 works as selection keys by the surface being touched. Numeric keys 302 are for inputting numerals. By pressing a start key 303, a copying operation is started.

Figure 5:
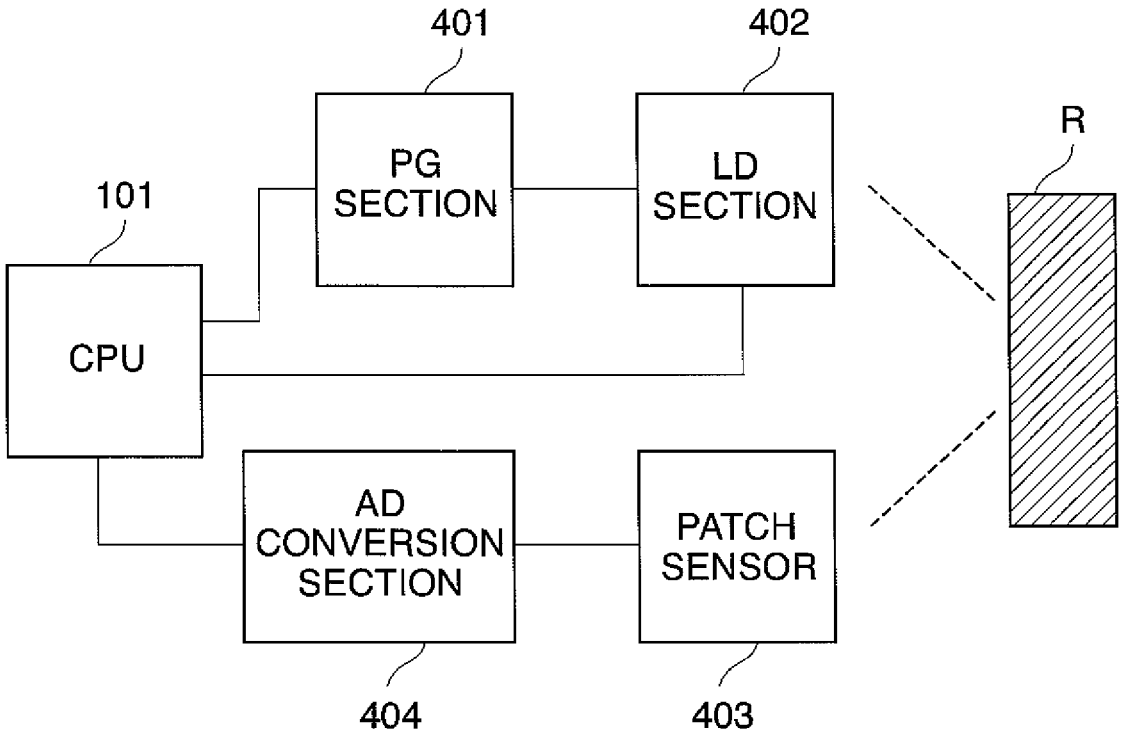
FIG. 5 is a block diagram schematically showing the configuration of generating a registration patch in the image forming apparatus in FIG. 1.

FIG. 5 is a block diagram schematically showing the configuration of generating a registration patch in the image forming apparatus in FIG. 1.

In FIG. 5, the CPU 101 sets data about a registration patch R in a pattern generator (PG) section 401. The PG section 401 can generate a simple image such as a rectangle at an arbitrary position at arbitrary timing.

The CPU 101 controls a laser driver (LD) section 402 on the basis of image data, and the LD section 402 forms the registration patch R on the photosensitive drum 3 on the basis of the image data set in the PG section 401.

The registration patch R transferred onto the intermediate transfer member 7 is read by a patch sensor 403. The read electrical signal is converted to digital data by an AD conversion section 40 and handed to the CPU 101.

Figure 6:
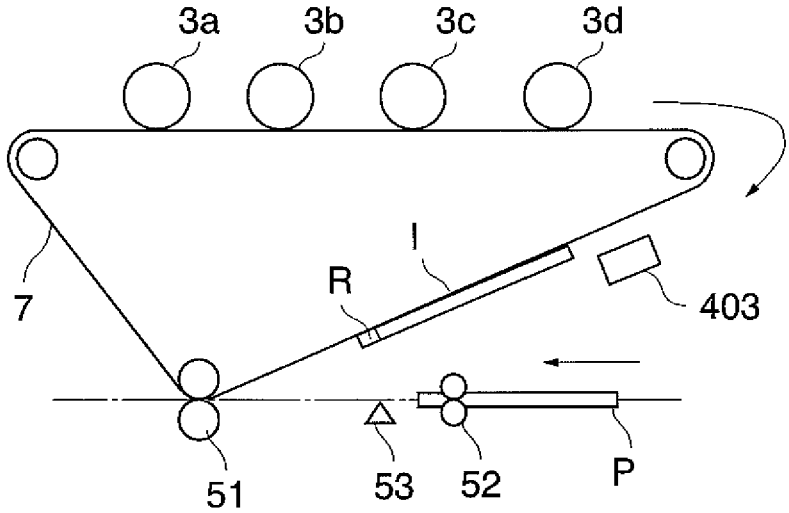
FIG. 6 is a view useful in illustrating image registration processing by the image forming apparatus in FIG. 1.

FIG. 6 is a view useful in illustrating image registration processing by the image forming apparatus in FIG. 1.

In FIG. 6, a yellow photosensitive drum 3*a*, a cyan photosensitive drum 3*b*, a magenta photosensitive drum 3*c* and a black photosensitive drum 3*d* are arranged around the intermediate transfer member 7 as the photosensitive drums 3 in FIG. 1.

The patch sensor 403 for detecting the registration patch R is arranged in the vicinity of the intermediate transfer member 7. An image I transferred to the intermediate transfer member 7 is transferred to a sheet P at the position of secondary transfer rollers 51.

Figure 7A:
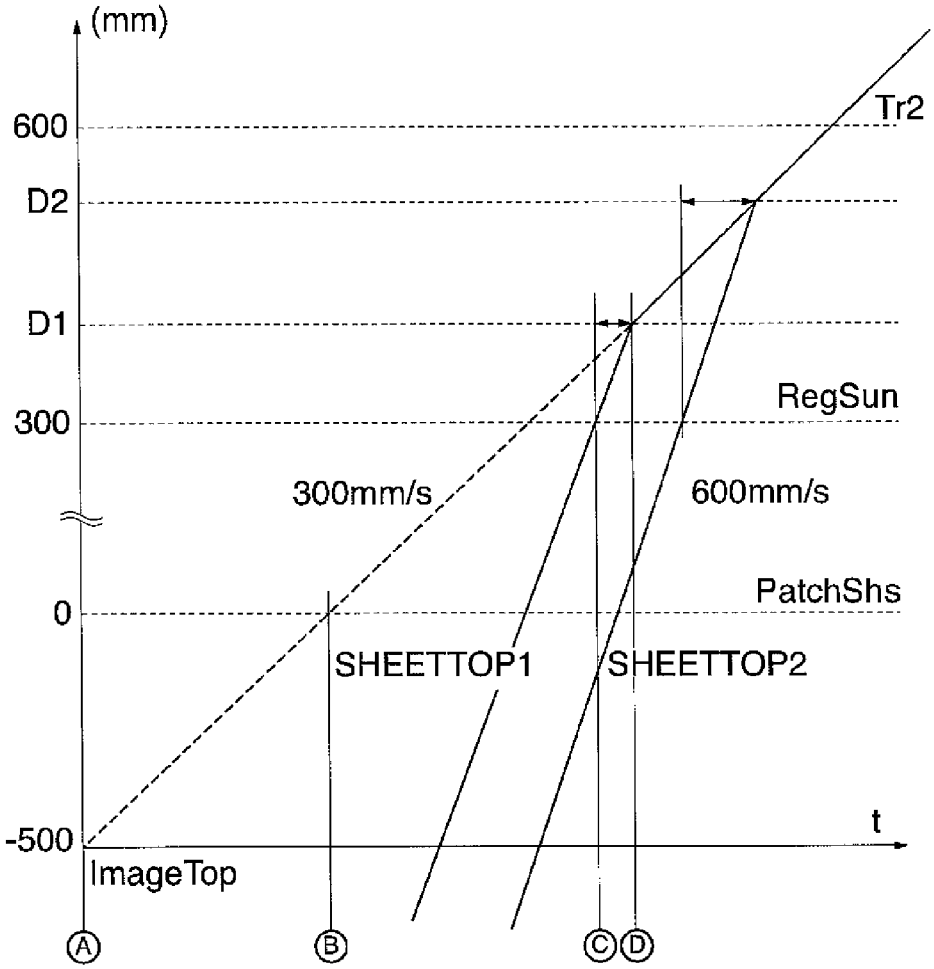
FIGS. 7A and 7B show a timing chart useful in illustrating the image registration processing in FIG. 6.
Figure 7B:
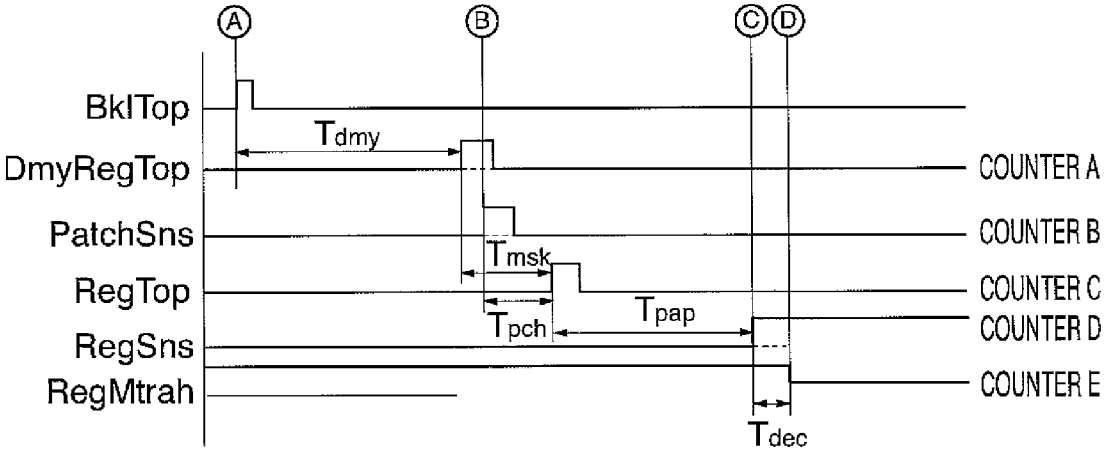

Resist rollers 52 adjust the speed of carrying the sheet P so that the image I is transferred to the sheet P at the position of the secondary transfer rollers 51. As shown in FIGS. 7A and 7B, the sheet P is first conveyed by the resist rollers 52 at a conveying speed of 600 mm/s (SheetTop1 and SheetTop2). Then, at a predetermined position (D1 or D2) after the top end of the sheet P passes through a resist sensor 53, the speed of the sheet P is reduced to an image forming process speed 300 mm/s. In FIGS. 7A and 7B, each of SheetTop1 and SheetTop2 indicates the track of the top of the sheet P when the conveying speed is 600 mm/s.

This predetermined position, that is, the speed reduction start position is determined from a timing of detecting the registration patch R by the patch sensor 403 and a timing of detecting the top end of the sheet P by the resist sensor 53.

In FIGS. 7A and 7B, in the case of early arrival, the speed is reduced at the position near the resist sensor 53 (D1) as shown by SheetTop1, and in the case of delay, the speed is reduced at the position near the secondary transfer roller 51 (D2) as shown by SheetTop2.

The distance from the patch sensor 403 to the secondary transfer rollers 51 is 600 mm, and the conveying speed of the registration patch R and the image I is 300 mm/s. Therefore, a time Tpatch required until the registration patch R reaches the secondary transfer rollers 51 after the detection of the registration patch R by the patch sensor 403 is: Tpatch=600×1000/300=2000 ms.

A time required until the resist sensor 53 detects the top end of the sheet P after the detection of the registration patch R by the patch sensor 403 is denoted by T. In this case, a time Treg required until the registration patch R reaches the secondary transfer rollers 51 after the detection of the top end of the paper P by the resist sensor 53 is: Treg=Tpatch−T=2000−T.

The distance from the resist sensor 53 to the secondary transfer rollers 51 is 300 mm. Therefore, if a speed changing time is ignored, a time Tn required until speed reduction is started after the top end of the sheet P passes through the resist sensor 53 is determined from the equation 600×Tn/1000+300×(Treg−Tn)/1000=300 mm, and shown as: Tn=Treg−1000 (ms).

That is, by measuring the time Treg, which is the time required until the top end of the sheet P is detected by the resist sensor 53 after the registration patch R is detected by the patch sensor 403, the timing of reducing the speed after the sheet P passes through the resist sensor 53 can be specified. Strictly, the value is a little different from the above parameter because the speed changing time of the resist rollers 52 is taken into account.

FIGS. 7A and 7B show a timing chart useful in illustrating the image registration processing in FIG. 6.

In response to an image top-end reference signal BklTop of the black image forming section, measurement of a time Tdmy by the counter A is started. In response to an over signal DmyRegTop indicating that the time Tdmy is over, measurement of a time Tmsk by the counter B is started.

When a registration patch R detection signal PatchSns comes within Tmsk, Tpch (a first reference signal) is measured by the counter C, and the Tmsk counter is cleared. On the other hand, if the registration patch R detection signal PatchSns is not inputted within the time Tmsk because of some trouble (for example, change in gloss or a scratch of the intermediate transfer member 7), measurement of the time Tmsk is continued (a second reference signal). The second reference signal according to the present invention is configured by Tdmy+Tmsk.

In responses to an over signal RegTop indicating that the time Tpch or the time Tmsk is over, measurement of a time Tpap by the counter D is started. A time Tdec at which speed reduction is to be started is calculated by the arithmetic expression described before, on the basis of the time Tpap, which is the time required until a signal RegSns indicating that the top end of the sheet P has reached the resist sensor 53 comes. After measuring the time Tdec by the counter E, the speed of a registration motor (not shown) is reduced so that the conveying speed of the sheet P is changed to 300 mm/s.

Figure 8:
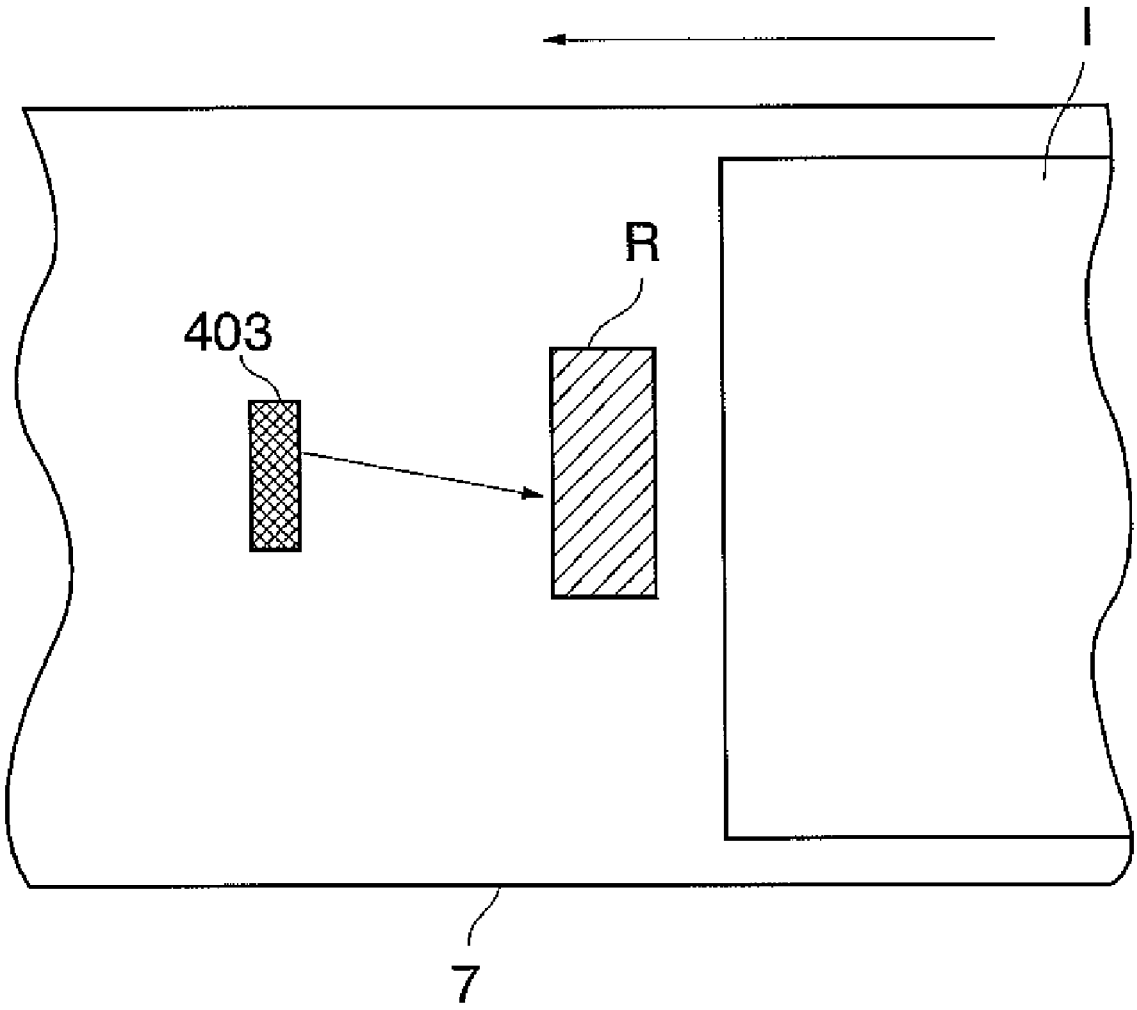
FIG. 8 is a view useful in illustrating the relation between a registration patch R and an image I in FIG. 6.

FIG. 8 is a view useful in illustrating the relation between the registration patch R and the image I in FIG. 6.

In FIG. 8, the registration patch R is transferred onto the intermediate transfer member 7. The patch sensor 403 can detect the top-end position of the image I by detecting the registration patch R.

Figure 9:
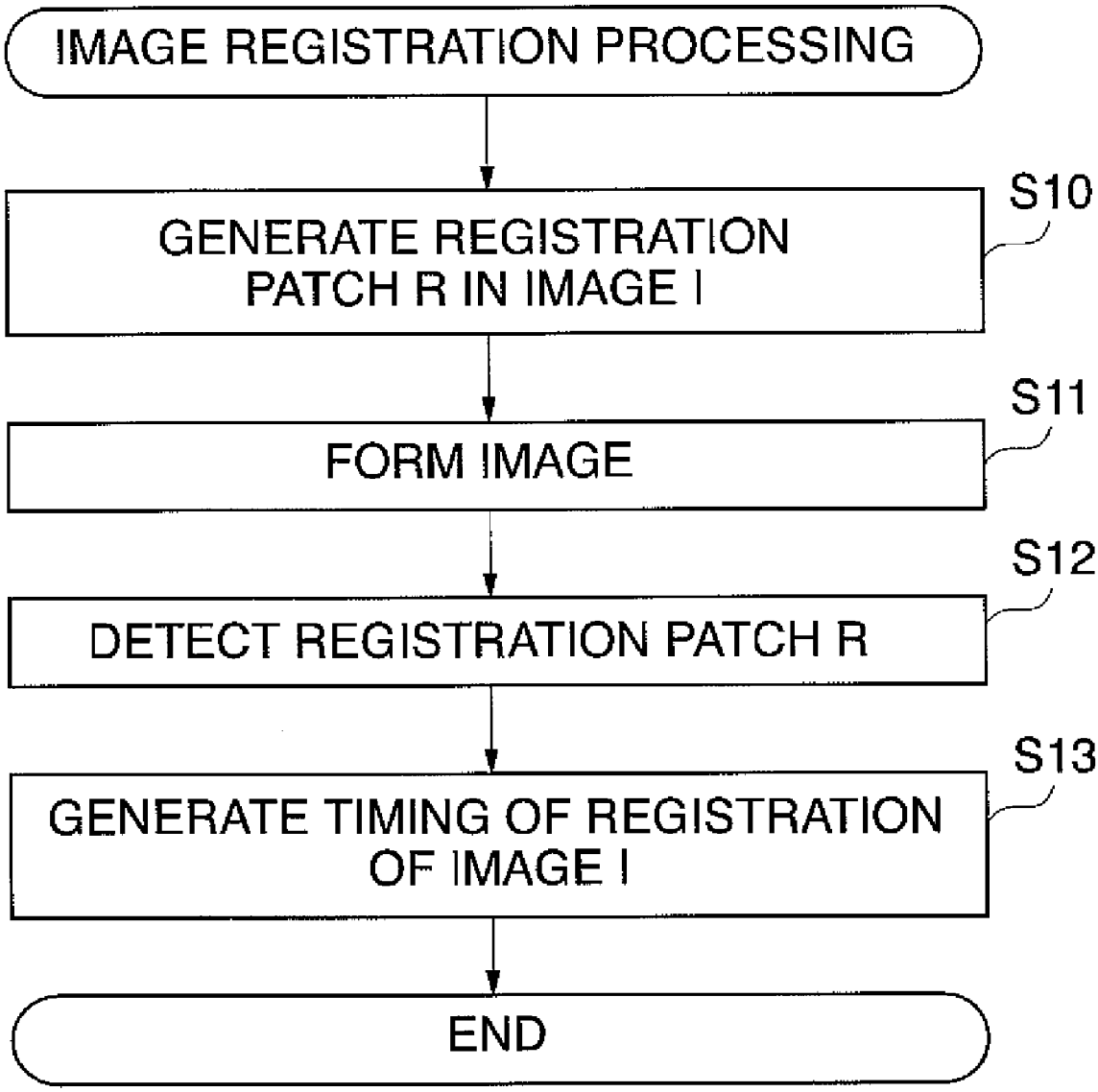
FIG. 9 is a flowchart showing the procedure for the image registration processing implemented by the image forming apparatus in FIG. 1.

FIG. 9 is a flowchart showing the procedure for the image registration processing implemented by the image forming apparatus in FIG. 1.

This processing is implemented by the CPU 101.

In FIG. 9, in order to perform registration of the image I with the paper P, the registration patch R is generated within the image I as image data first (step S10), followed by forming an image (step S11).

Then, the registration patch R is detected by the patch sensor 403 (step S12), and the timing of performing registration of the image I with the sheet P is generated from the timing of detecting the registration patch R (step S13).

Figure 10:
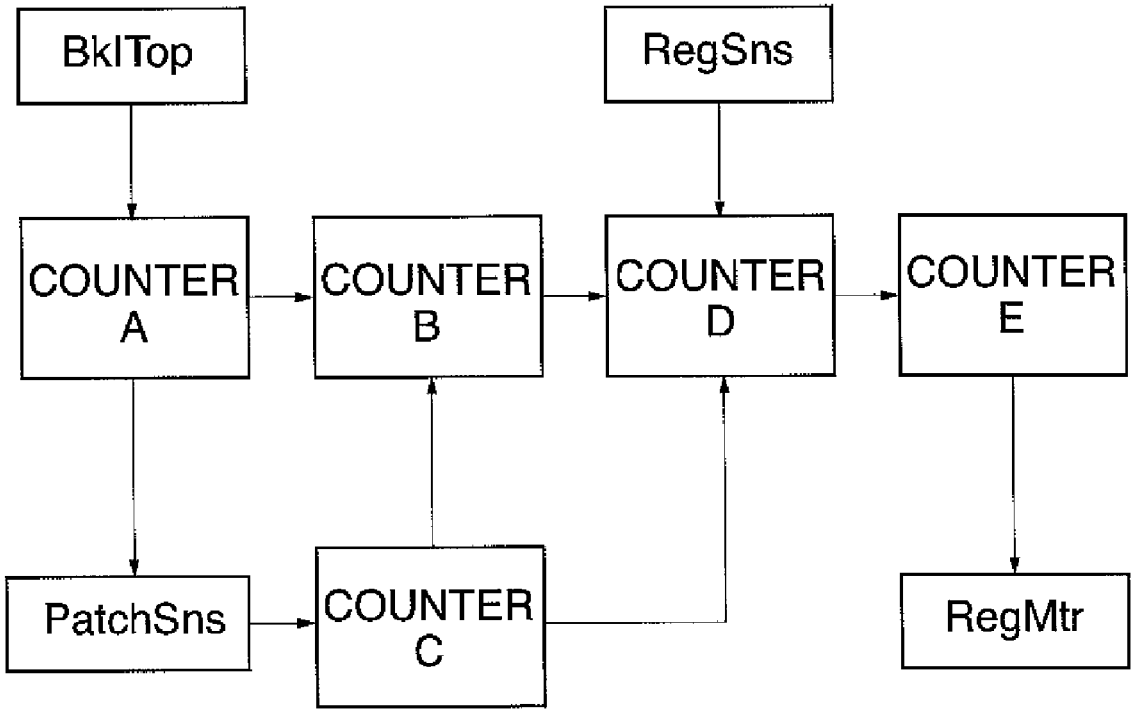
FIG. 10 is a block diagram illustrating respective operations of counters A to E in the image registration processing in FIG. 9.

FIG. 10 is a block diagram illustrating respective operations of the counters A to E in the image registration processing in FIG. 9.

FIGS. 11 to 15 are flowcharts illustrating the operations of the counters A to E in FIG. 10, respectively.

Figure 11:
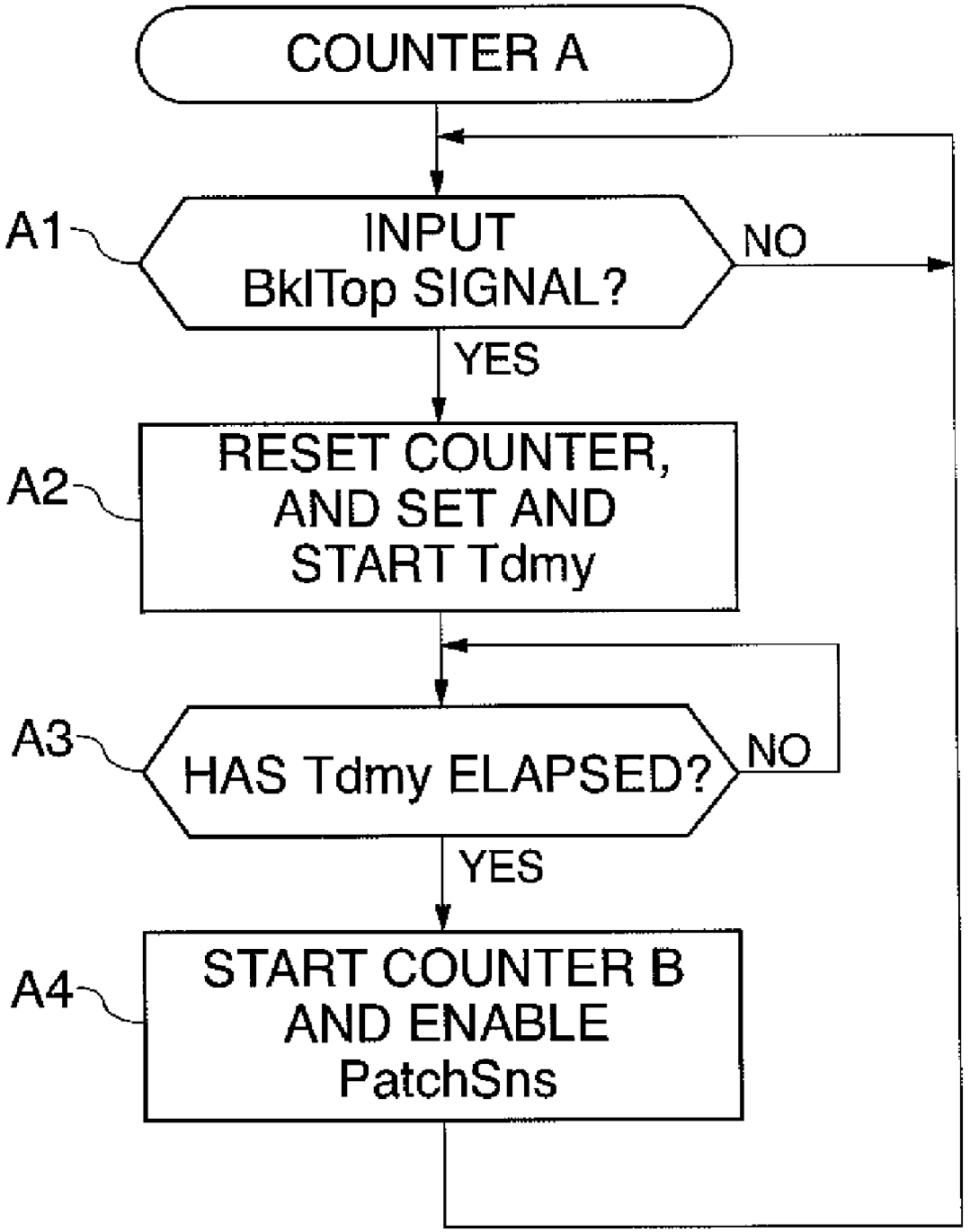
FIG. 11 is a flowchart illustrating the operation of the counter A in FIG. 10.

In FIG. 11, when the BklTop signal is inputted to the counter A (step A1), the counter A starts counting the time Tdmy (step A2). When the time Tdmy has elapsed (step A3), the counter B is started, and at the same time, input of the PatchSns signal is enabled (step A4).

Figure 12:
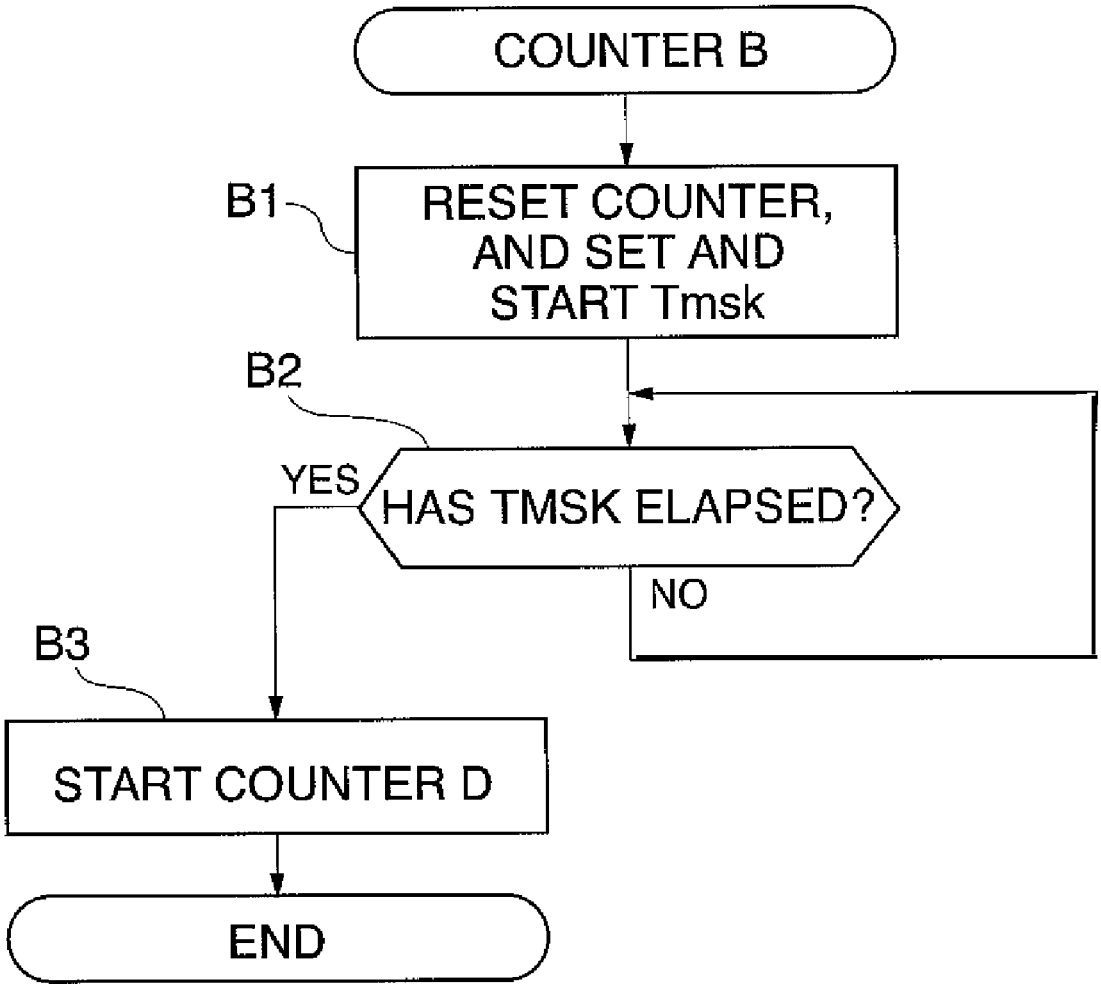
FIG. 12 is a flowchart illustrating the operation of the counter B in FIG. 10.

In FIG. 12, after starting (step B1), the counter B starts counting the time Tmsk (step B2), and causes the counter D to start.

Figure 13:
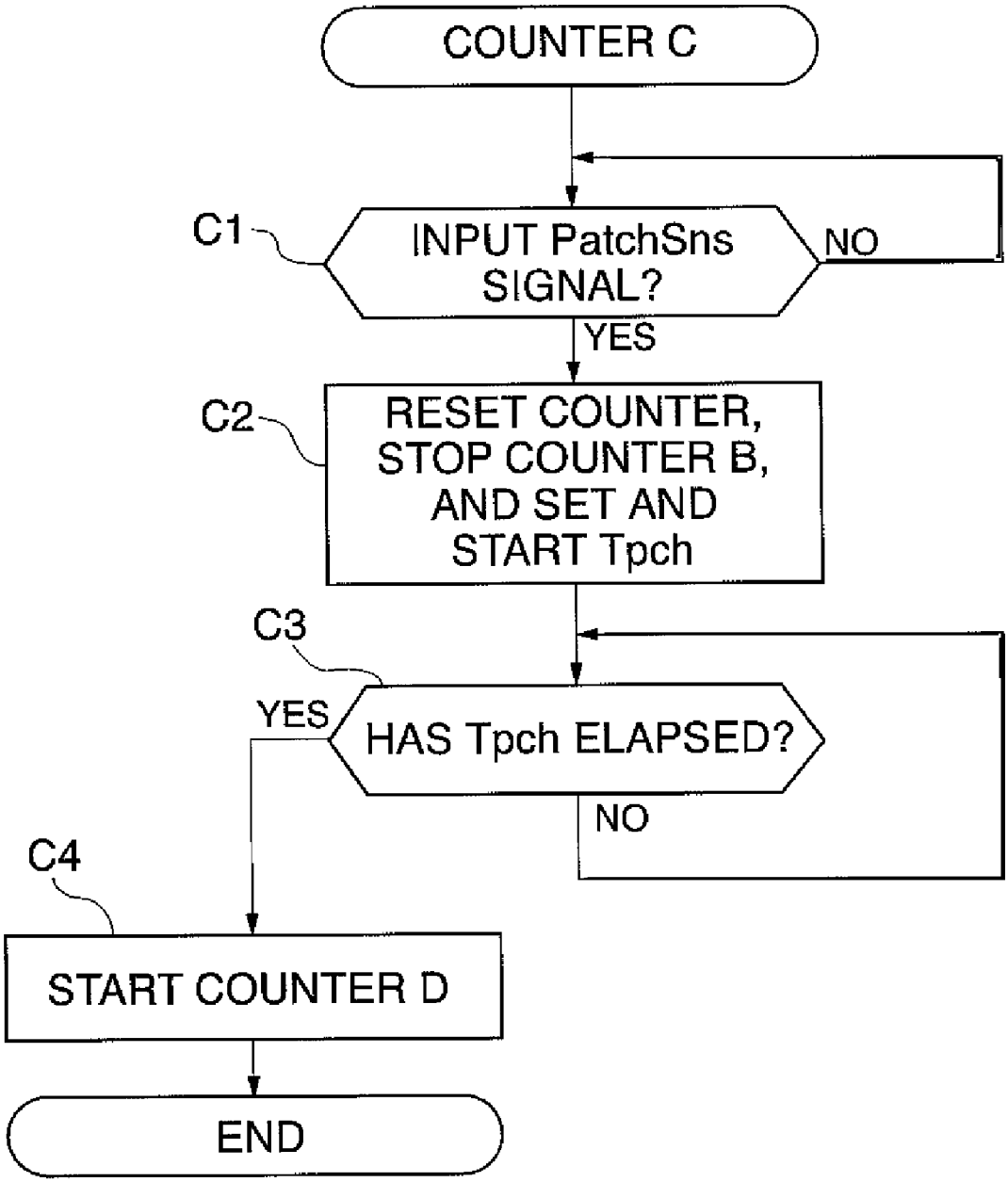
FIG. 13 is a flowchart illustrating the operation of the counter C in FIG. 10.

In FIG. 13, when the PatchSns signal is inputted within the time Tmsk (step C1), the counter C causes the counter B to stop and starts counting the time Tpch (step C2). When the time Tpch has elapsed (step C3), the counter D is started.

Figure 14:
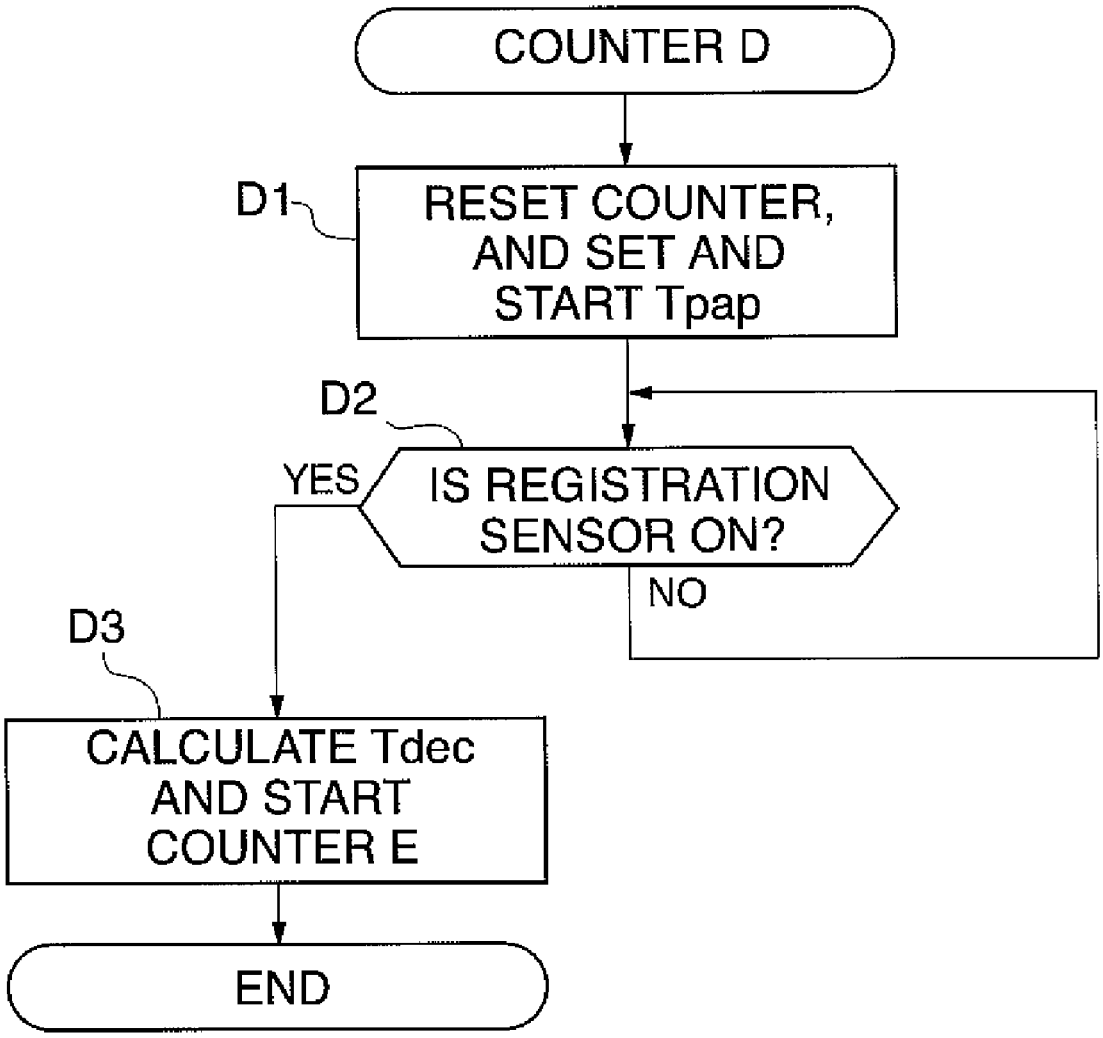
FIG. 14 is a flowchart illustrating the operation of the counter D in FIG. 10.

In FIG. 14, after starting (step D1), the counter D counts the time Tpap required until a registration sensor is on (step D2), calculates the time Tdec on the basis of the time Tpap, and causes the counter E to start (step D3).

Figure 15:
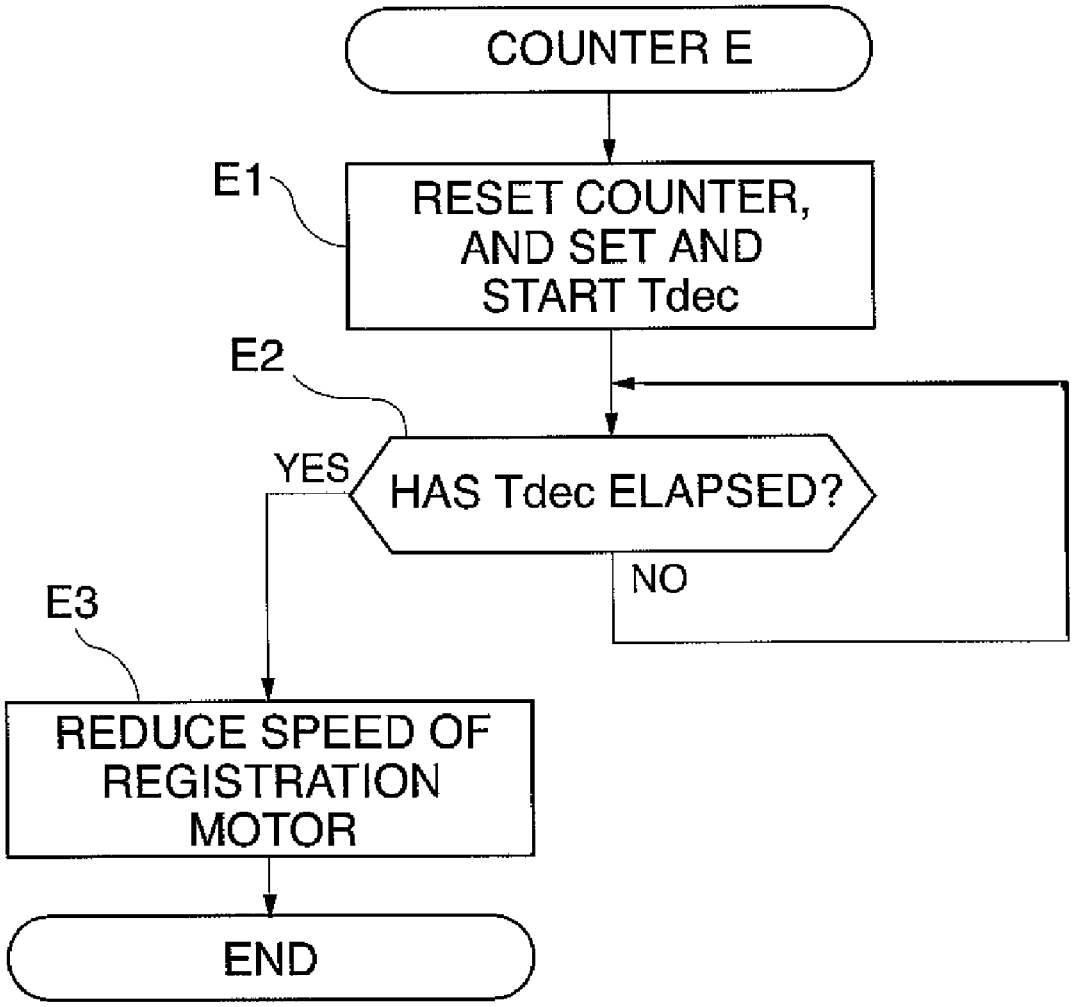
FIG. 15 is a flowchart illustrating the operation of the counter E in FIG. 10.

In FIG. 15, after starting (step E1), the counter E counts the time Tdec (step E2), and reduces the speed of the registration motor (step E3).

According to the embodiment described above, when the PatchSns signal does not arrive within the reference time from Tdmy to Tmsk of the BklTop signal, the speed reduction start position where reduction of the conveying speed of the sheet P is started is adjusted with the time (Tdmy+Tmsk) (the second reference signal) as the reference, and, when the PatchSns signal arrives within the reference time from Tdmy to Tmsk of the BklTop signal, the above speed reduction start position is adjusted with the time Tpch as the reference.

In the embodiment described above, by any of the counters B and C being selected, the counter D can be started even in the case of any timing abnormality of the PatchSns signal which is a registration patch R detection signal. Thus, even if the PatchSns signal cannot be detected, it is possible to prevent failure in image forming.

In the embodiment below, updating the time Tdmy which is counted by the counter A and which is the start trigger of the counter B, by a learning function, makes it possible to perform more accurate registration.

Figure 16:
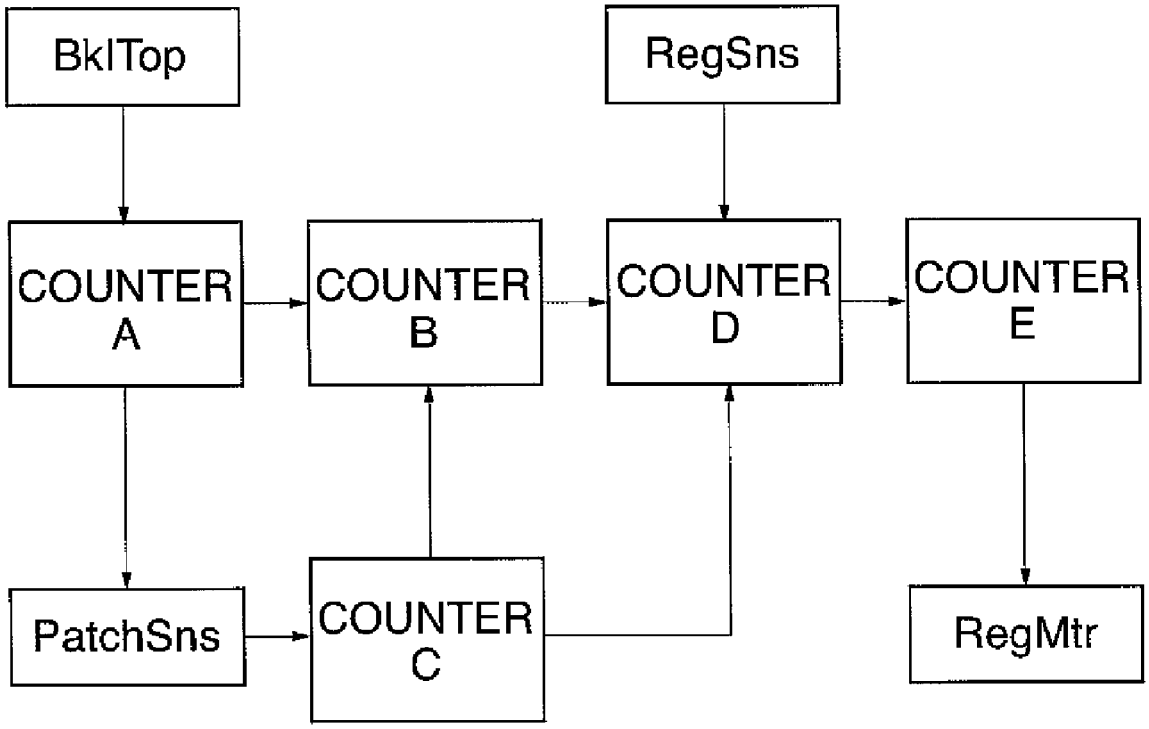
FIG. 16 is a block diagram schematically showing the configuration of a counter F in the image registration processing in FIG. 9.
Figure 17:
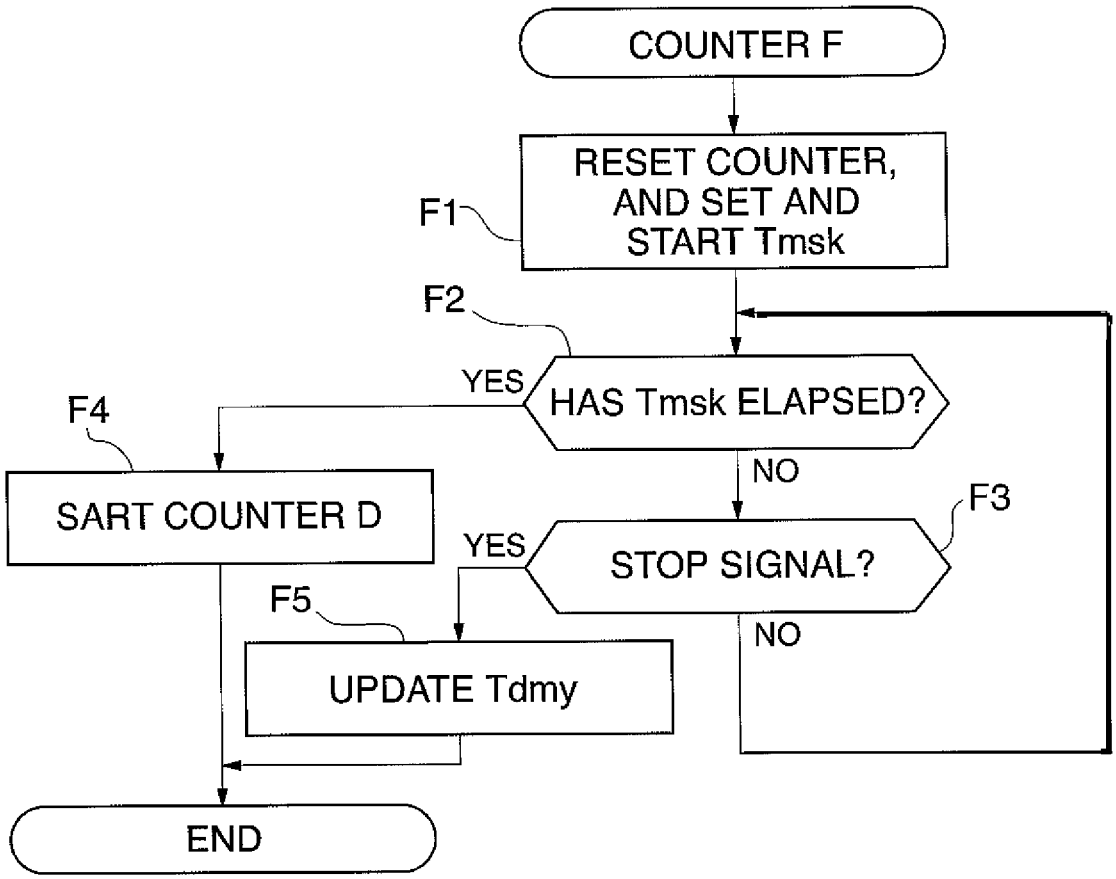
FIG. 17 is a flowchart illustrating the operation of the counter F in FIG. 16.

FIG. 16 is a block diagram schematically showing the configuration of the counter F in the image registration processing in FIG. 9. FIG. 17 is a flowchart illustrating the operation of the counter F in FIG. 16.

In FIG. 17, after starting (step F1), the counter F counts the time Tmsk and monitors a stop signal from the counter C (step F2). When the time Tmsk has elapsed (YES to the step F2), the counter D is started (step F4). On the other hand, when a stop signal from the counter C is received (YES to step F3) before the time Tmsk elapses (NO to the step F2), the time Tdmy data of the counter A is updated.

Since it is assumed that the PatchSns signal is inputted in the middle of the time Tmsk, $\Delta T = Tr - Tmsk/2$ is calculated on the basis of a count value Tr of the counter F at the time of receiving the stop signal from the counter C. Then, the time Tdmy is updated by the formula $Tdmy = Tdmy + \Delta T$ to obtain a learned value of the time Tdmy.

Thus, even if the PatchSns signal is not inputted because of a scratch and the like on the photosensitive drums 3 or the intermediate transfer member 7, it is possible to accurately perform registration of an image with paper.

$\Delta T$ may denote an average value of plural pieces of data obtained.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims priority from Japanese Patent Application No. 2006-327114 filed Dec. 4, 2006, which is hereby incorporated by reference herein in its entirety.

What is claimed is:

1. An image forming apparatus comprising a registration device adapted to change a first conveying speed of a sheet being conveyed on a conveying path to a second conveying speed at a predetermined position to thereby perform registration of an image on an image bearing member with the sheet, at a position of the image being transferred to the sheet, said image forming apparatus further comprising:

a forming device adapted to form a registration-use image on the image bearing member;

a registration-use image sensor adapted to detect the registration-use image on the image bearing member to thereby generate a first reference signal; and a sheet detection sensor adapted to detect a top end of the sheet conveyed on the conveying path to thereby generate a second reference signal, wherein said registration device is adapted to determine the predetermined position on the basis of the first reference signal when said registration-use image sensor has successfully generated the first reference signal, and to determine the predetermined position on the basis of the second reference signal when said registration-use image sensor does not successfully generate the first reference signal.

2. An image forming apparatus according to claim 1, wherein the second conveying speed is less than the first conveying speed.

3. An image forming apparatus according to claim 2, wherein the second carrying speed is an image forming process speed.

4. An image forming apparatus according to claim 1, wherein the second reference signal comprises a learned value of the detected data of the registration-use image on said image bearing member.

5. An image forming apparatus according to claim 4, wherein the learned value includes an average value of plural pieces of data obtained.

* * * * *